US006431655B1

(12) United States Patent
Mantovani

(10) Patent No.: US 6,431,655 B1
(45) Date of Patent: Aug. 13, 2002

(54) BREAKER DEVICE FOR REMOVING THE TOPS OF COLUMNS

(75) Inventor: Alberto Mantovani, Modena (IT)

(73) Assignee: Mantovanibenne S.r.l., Modena (IT)

( * ) Notice: Subject to any disclaimer, the term of this patent is extended or adjusted under 35 U.S.C. 154(b) by 0 days.

(21) Appl. No.: 09/669,630

(22) Filed: Sep. 26, 2000

(30) Foreign Application Priority Data

Oct. 18, 1999 (IT) ..... M099A0225

(51) Int. Cl.[7] ..... B28D 1/26; E02D 9/00
(52) U.S. Cl. ..... 299/69; 125/40; 173/101
(58) Field of Search ..... 299/69; 125/23.01, 125/40; 173/37, 101; 59/86, 88, 89

(56) References Cited

U.S. PATENT DOCUMENTS 4,221,269 A * 9/1980 Hudson ..... 173/163
5,025,803 A * 6/1991 van der Toorn ..... 125/23.01
5,560,630 A * 10/1996 Phares et al. ..... 280/416.1

FOREIGN PATENT DOCUMENTS

JP 55039544 A * 3/1980 ..... E02D/9/00
JP 04131424 A * 5/1992 ..... E02D/9/04
NL 8400404 A * 9/1985 ..... B28D/1/00

* cited by examiner

*Primary Examiner*—David Bagnell
*Assistant Examiner*—Daniel P Stephenson
(74) *Attorney, Agent, or Firm*—Browdy and Neimark

(57) ABSTRACT

The breaker device for removing the tops of columns comprises a support structure composed of a plurality identical chain elements reciprocally linked by link couplings to form a closed chain which can surround a column which is to be topped. Each chain element bears a jackhammer provided with a plurality of interchangeable breaker punches, of varying lengths. Each chain element exhibits a plurality of holes which are distanced from the link couplings and which are for linking the chain elements. Each hole is aligned with a corresponding hole of an adjacent chain element. A pin is used for blocking adjacent chain elements in predetermined positions. The invention is useful for breaking the stop of a reinforced-concrete column without damaging the reinforcement elements thereof. The device can be adapted to columns having different diameters.

6 Claims, 3 Drawing Sheets

BREAKER DEVICE FOR REMOVING THE TOPS OF COLUMNS

BACKGROUND OF THE INVENTION

Specifically, though not exclusively, the invention is used in breaking up a top of a reinforced-concrete column without damaging the reinforcement elements. In particular, reference is made to a device described in the preamble to the first claim hereof.

A device of this type is taught in Netherlands publication no. 9000008, which addressed the problem of realizing a device able to top columns having different diameters. The solution offered was to provide, for each jackhammer, a stop limiting the run of the activating jack of the tool.

This solution (Netherlands publication no. 9000008) can be improved upon from the point of view of the ability of the device to adapt itself to columns of different diameters and shapes, while conserving excellent operative results.

SUMMARY OF THE INVENTION

The main aim of the present invention is to provide a device, constructionally simple and. economical, which is extremely flexible, and easily and swiftly adaptable to columns having different sizes and shapes, without losing anything in terms of performance.

An advantage of the invention is its ability to demolish both round and square columns.

A further advantage is that it provides a device which operates considerably quickly and accurately.

A further advantage is that it makes available a device of considerable structural solidity and sturdiness.

These aims and advantages and others besides are all achieved by the present invention, as it is characterised in the appended claims.

BRIEF DESCRIPTION OF THE DRAWINGS

Further characteristics and advantages of the present invention will better emerge from the detailed description that follows of an embodiment of the invention, illustrated by way of example and not to be considered limiting in the accompanying figures of the drawings, in which:

FIG. 3 shows a device, made according to the invention, in a configuration which is useful for removing the top from hollow columns as well as for demolishing tubular structures such as tanks and the like;

DESCRIPTION OF THE PREFERRED EMBODIMENTS

Figure 2:
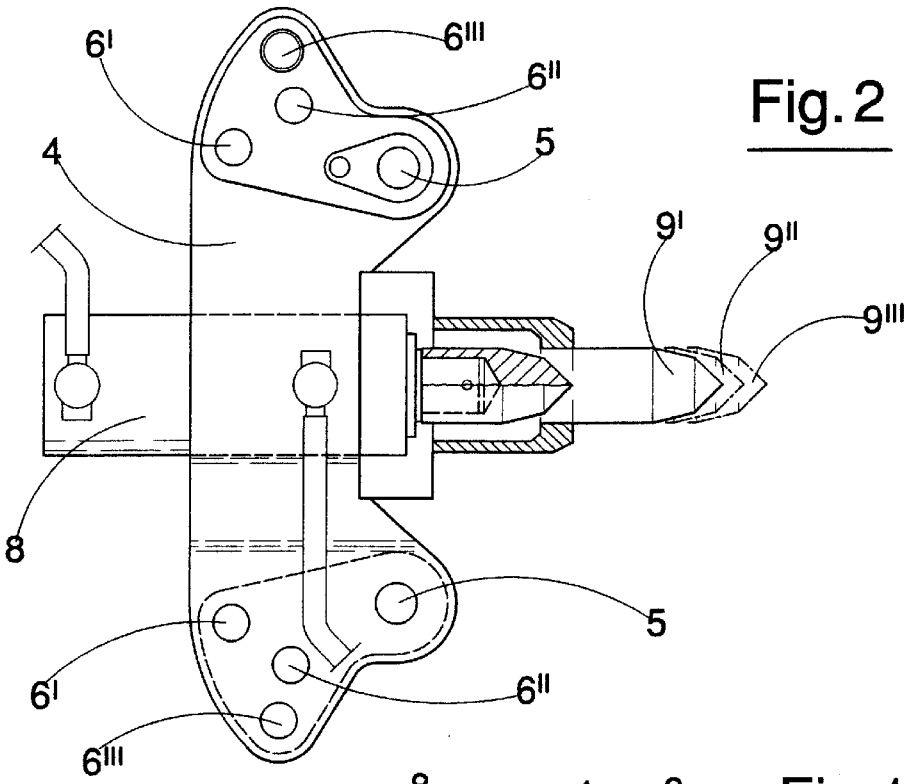
FIG. 2 shows an enlarged view of a detail of the device of FIG. 1.
Figure 1:
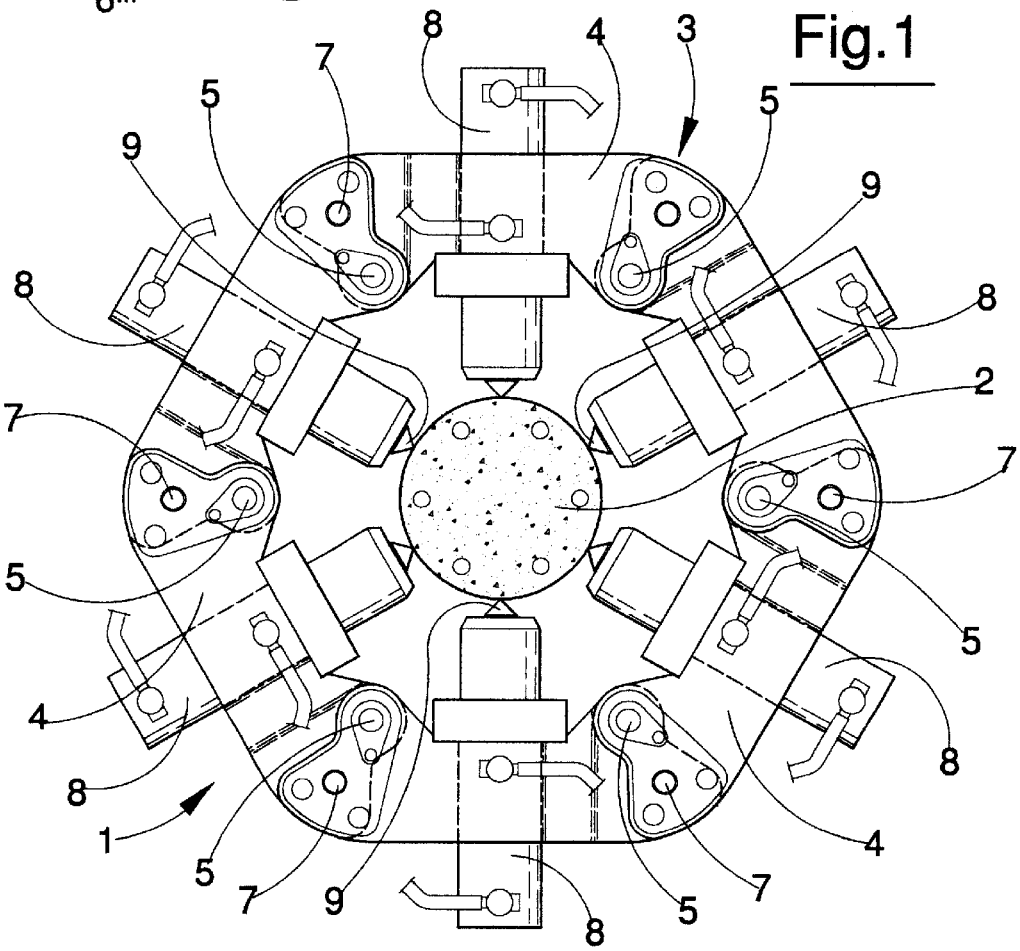
FIG. 1 shows a schematic plan view from above of a device made according to the present invention.

With reference to FIGS. 1 and 2 of the drawings, 1 denotes in its entirety a device for removing the top from a column 2, especially a reinforced-concrete column. This operation, common in construction work, consists in breaking up the concrete while uncovering the reinforcement elements and leaving them intact.

The device 1 comprises a modular support structure 3 composed of a plurality of chain elements 4 reciprocally constrained by links 5 to form a closed chain which can surround the column 2 to be topped.

The chain elements 4 are identical to each other and each is provided with a plurality of holes 6', 6", 6'" afforded at a distance from the link 5 coupling two chain elements 4. Each hole 6', 6", 6'" is aligned with a corresponding hole 6', 6", 6'" in an adjacent chain element 4. The holes, thus aligned, receive a pin 7 which blocks the adjacent chain elements 4 in predetermined positions.

In FIG. 1 the structure comprises six chain elements 4, each of which represents a. module of the structure 3, arranged so as to form a chain in the shape of a regular hexagon in which each side is represented by a chain element 4. In the illustrated embodiment, the chain elements 4 are blocked by insertion of pins 7 into the holes indicated by 6" in FIG. 2. The chains can be arranged in polygon shapes other than hexagons; it is sufficient to remove or add chain elements 4 and insert the pins 7 in the holes 6' and 6'", specially located in the exactly right positions for obtaining the desired relative inclinations between the chain elements 4. In FIG. 2 three holes 6', 6" and 6'" are shown, with which three different chains can be increasing the number of holes a greater number of chains can be obtained.

The structure 3 is equipped with a plurality of jackhammers 8, each provided with at least one breaker punch 9 for penetrating the column 2. The various punches 9 are arranged around the column circumference, facing the column center. Each jackhammer 8 is kitted with a plurality of interchangeable breaker punches 9, each of a different length. In FIG. 2 three punches 9', 9", 9'" are shown, selectively applicable on the jackhammer 8.

To optimize the device 1 performance, each interchangeable punch 9 9', 9", 9'", is suitable for use with a chain having a specific number of sides and with columns 2 having a diameter which is within a certain interval. When changing the number of sides of the chain 4, and in consideration of the diameter of the column to be topped, it is opportune also to change the length of the punch which will go to penetrate the column 2.

Figure 3:
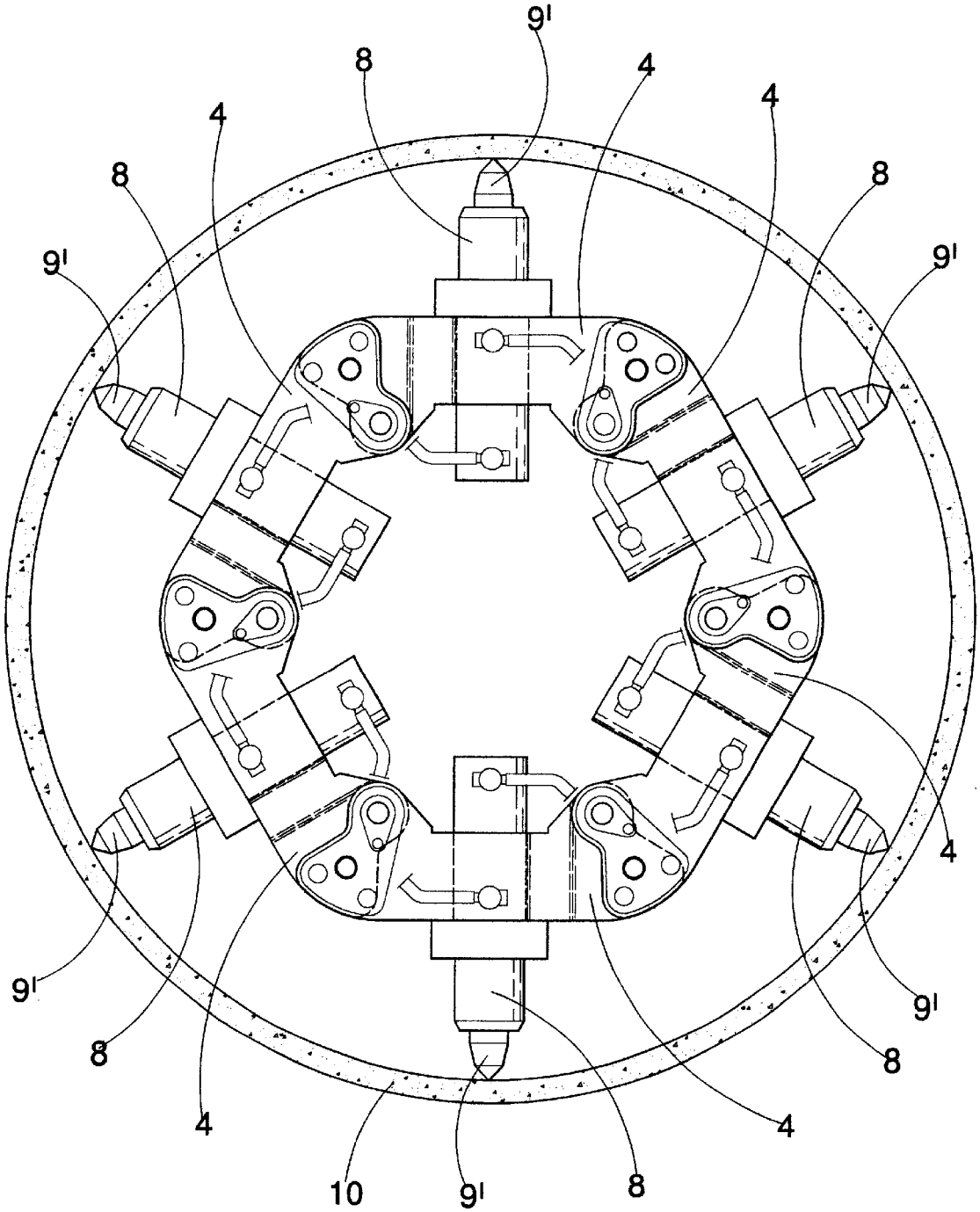

FIG. 3 shows a device in which each chain element 4 is predisposed to receive at least one jackhammer 8 with the breaker punch 9' selectively turned either internally or externally of the support structure 3. In the embodiment illustrated in FIG. 3, the jackhammers 8 are mounted with the breaker punches 9'facing externally. In this case the device can be used for demolishing. a tubular wall 10 (for example, a hollow column or a tank), working from the inside of the tubular structure.

Figure 4:
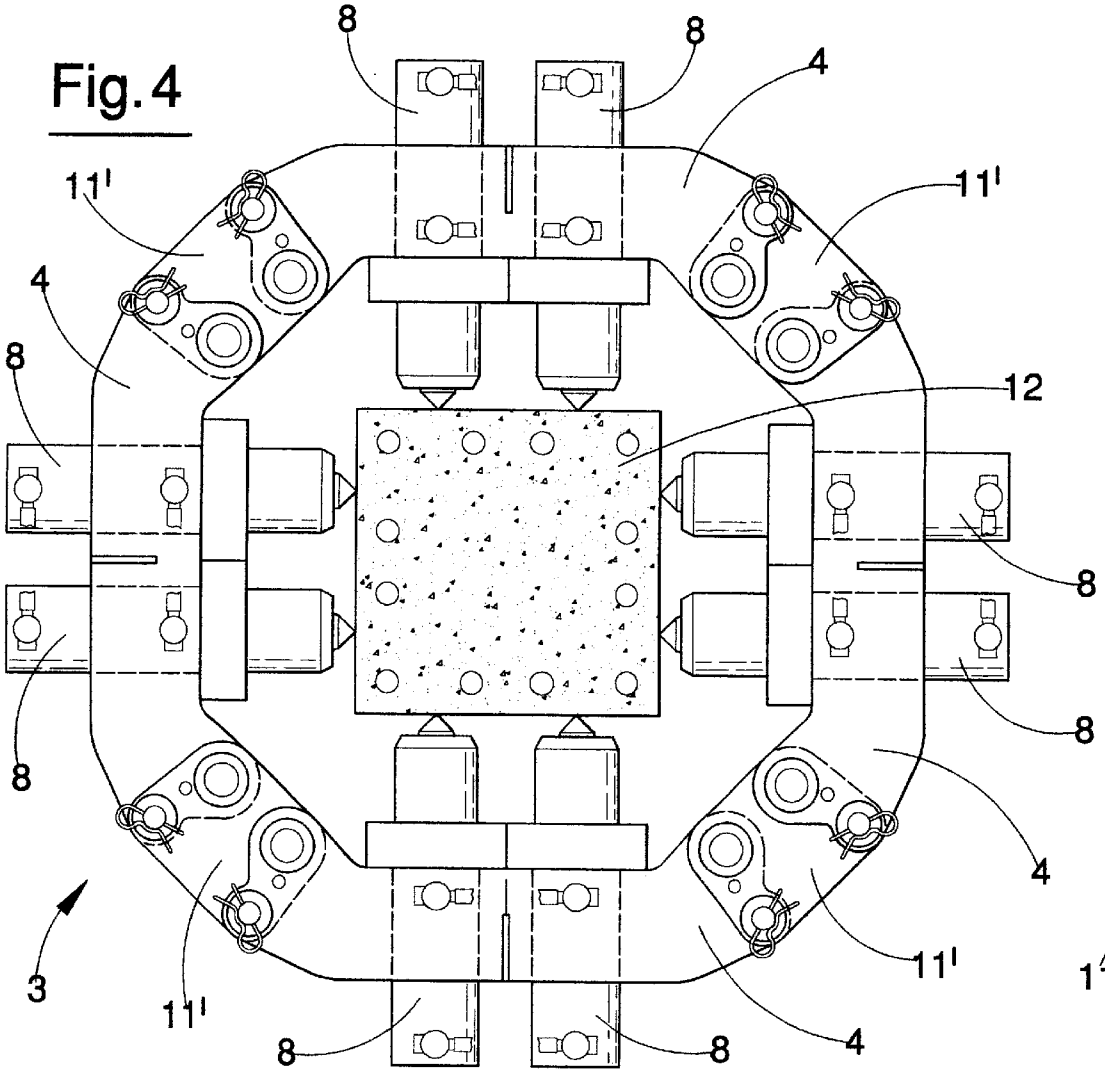
FIG. 4 shows a device made according to the invention, in a configuration in which it can remove the top of a square-section column.

FIG. 4 shows a device in which the support structure 3 comprises a plurality of intermediate chain elements 11 which are predisposed to connect up to two adjacent chain elements 4. The device of FIG. 4 is suited to topping square columns 12. The device can be adapted to square columns having sides of different lengths, with the insertion of special intermediate chain elements 11' and 11", each having a special arrangement of the holes 50', 50" and 60',60" destined to form the chains in collaboration with the holes of the main chain 5 and, respectively, 6.

Figure 5:
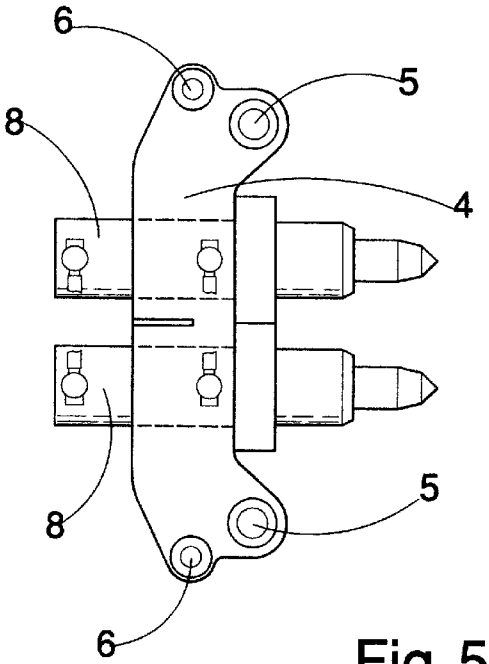
FIG. 5 shows some details of the device of FIG. 4.
Figure 5:
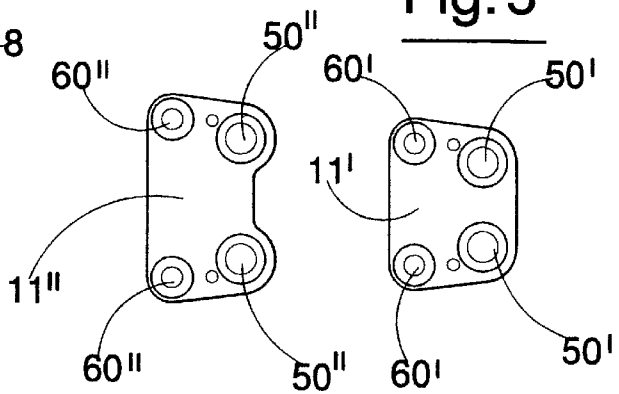

FIG. 5 shows two different types of intermediate chain elements 11' and 11". Each type can be used to form a basically square chain, i.e. one in which the main chain elements 4, bearing the jackhammers 8, are angularly arranged at 90° to one another. By using a specific intermediate element 11' or 11", it is possible to make a square chain having a specific side length.

Note that this result can be reached by using the same main chain elements 4 and changing only the intermediate chain elements.

What is claimed is:

1. A breaker device for removing the tops of columns, comprising:

a support structure composed of a plurality of chain elements reciprocally linked by link couplings to form a closed chain which can surround a column which is to be topped;

a plurality of jackhammers supported by the support structure, each of which plurality of jackhammers is provided with at least one breaker punch for penetrating the column;

wherein each of the plurality of jackhammers is provided with a plurality of breaker punches, which are interchangeable and which are of different lengths, each of the plurality of chain elements is identical to another, and in that each of the plurality of chain elements exhibits a plurality of holes which are distanced from the link couplings for linking the chain elements, each hole of the plurality of holes being aligned with a corresponding hole of the plurality of holes of an adjacent chain element, the plurality of holes, when aligned, being able to receive a pin for blocking adjacent chain elements in predetermined positions.

2. The device of claim 1, wherein the plurality of breaker punches, which are interchangeable and which are of different lengths, are interchanged according to selective variations in the predetermined positions of the chain elements.

3. The device of claim 2, wherein the support structure comprises a plurality of intermediate chain elements, which are predisposed to connect two adjacent chain elements of the plurality of chain elements.

4. The device of claim 1, wherein the support structure comprises a plurality of intermediate chain elements, which are predisposed to connect two adjacent chain elements of the plurality of chain elements.

5. The device of claim 1, wherein each chain element of the plurality of chain elements is predisposed so that at least one of the plurality of jackhammers can be mounted thereon, with a breaker punch of the at least one of the jackhammers being positioned so as to face inwardly or outwardly of the support structure, so that when the breaker punch is facing outwardly of the support structure, the device can be used for demolishing a tubular wall by being positioned inside the tubular wall.

6. The device of claim 1, wherein said plurality of intermediate chain elements are composed of at least four chain elements, and said plurality of jackhammers are composed of at least four jackhammers each supported by a respective one of said chain elements.

* * * * *